US008378594B2

(12) United States Patent
Chen

(10) Patent No.: US 8,378,594 B2
(45) Date of Patent: Feb. 19, 2013

(54) LIGHT OUTPUT CONTROL TECHNIQUE BY ESTIMATING LAMP EFFICACY AS A FUNCTION OF TEMPERATURE AND POWER

(75) Inventor: Nancy H. Chen, North Andover, MA (US)

(73) Assignee: Osram Sylvania Inc., Danvers, MA (US)

( * ) Notice: Subject to any disclaimer, the term of this patent is extended or adjusted under 35 U.S.C. 154(b) by 418 days.

(21) Appl. No.: 12/769,813

(22) Filed: Apr. 29, 2010

(65) Prior Publication Data

US 2011/0266978 A1 Nov. 3, 2011

(51) Int. Cl.
*H05B 37/02* (2006.01)

(52) U.S. Cl. ..... 315/309; 315/50; 315/117; 315/118

(58) Field of Classification Search ..... 315/32, 315/50, 112, 117–118, 307–309; 700/299; 702/60, 64

See application file for complete search history.

(56) References Cited

U.S. PATENT DOCUMENTS

| | | | | |
|---|---|---|---|---|
| 4,709,184 | A | 11/1987 | Keefe et al. | |
| 4,859,899 | A | 8/1989 | Keefe et al. | |
| 4,963,790 | A | 10/1990 | White et al. | |
| 5,057,743 | A | 10/1991 | Krasko et al. | |
| 5,327,042 | A | 7/1994 | Bazin et al. | |
| 5,448,139 | A | 9/1995 | Luursema et al. | |
| 5,523,656 | A | 6/1996 | Luursema | |
| 5,694,002 | A | 12/1997 | Krasko et al. | |
| 6,127,789 | A * | 10/2000 | Ishizuka et al. | 315/308 |
| 6,184,632 | B1 * | 2/2001 | Kamata et al. | 315/225 |
| 6,208,088 | B1 | 3/2001 | Konishi et al. | |
| 6,856,102 | B1 * | 2/2005 | Lin et al. | 315/291 |
| 7,030,543 | B2 | 4/2006 | Galvez et al. | |
| 7,256,546 | B2 | 8/2007 | Brock et al. | |
| 7,589,477 | B2 | 9/2009 | Chen et al. | |
| 7,633,237 | B2 | 12/2009 | Chen et al. | |
| 2003/0062857 | A1 * | 4/2003 | Kling | 315/324 |
| 2004/0119425 | A1 * | 6/2004 | Okamoto et al. | 315/291 |
| 2006/0108930 | A1 | 5/2006 | Brock et al. | |
| 2009/0167211 | A1 | 7/2009 | Deppe | |

OTHER PUBLICATIONS

Aluminum Oxide (Al2O3) http://www-ferp.ucsd.edu/LIB/PROPS/PANOS/al2o3.html.

Karditsas et al., Thermal and Structural Properties of Fusion related Materials, http://www-ferp.ucsd.edu/LIB/PROPS/PANOS/matintro.html.

* cited by examiner

*Primary Examiner* — Jason M Crawford
(74) *Attorney, Agent, or Firm* — Andrew Martin

(57) ABSTRACT

Techniques are disclosed for controlling the light output of a lamp, where lamp efficacy is estimated as a function of estimated lamp temperature and instantaneous input power, or as a function of estimated lamp temperature only. Whether efficacy is estimated as a function of temperature and power, or as a function of temperature only can depend on changes in the lamp operating scenario. The techniques estimate lamp temperature by tracking energy input to and losses from (losses such as radiation, conduction, emission) the lamp arc tube, and determine the corresponding instantaneous light producing ability. The techniques may further be implemented to deliver the appropriate power command to obtain a desired light output. The techniques can be applied towards a general control in which arbitrary or custom light output vs. time paths are produced, and may be implemented by a processor programmed or otherwise configured to execute the desired control scheme.

27 Claims, 8 Drawing Sheets

LIGHT OUTPUT CONTROL TECHNIQUE BY ESTIMATING LAMP EFFICACY AS A FUNCTION OF TEMPERATURE AND POWER

TECHNICAL FIELD

The present application relates to gas-discharge lamps, and more particularly to controlling the light output of such lamps.

BACKGROUND

Metal halide lamps and other gas-discharge lamps are commonly used in a number of venues such as sporting arenas and stadiums, plant nurseries, and industrial plants. Like other gas-discharge lamps, metal halide lamps produce light by passing an electric arc through a mixture of gases contained in a discharge vessel (e.g., argon, mercury, and metal halides). The argon is readily ionized, and enables striking the arc across the lamp electrodes when voltage is applied to the lamp. The heat generated by the arc in turn vaporizes the mercury and metal halides, which produces light as the temperature and pressure increases within the discharge vessel (also referred to as an arc tube or burner). The halides generally control the color and intensity of the light produced.

There are a number of conventional techniques for controlling light output of metal halide lamps and other gas-discharge lamps during essentially two scenarios: lamp run-up and hot relight. For instance, conventional techniques for controlling light output during gas-discharge lamp run-up include: optical feedback; predetermined power vs. time to be applied; voltage feedback, including estimation of lamp efficacy as a function of lamp voltage; and estimation of lamp efficacy as a function of total energy delivered to lamp. Techniques for controlling hot relight of a gas-discharge lamp include: tracking time since lamp shut-off to modify the predetermined power vs. time to be applied; and using voltage feedback.

There are a number of non-trivial and subtle issues associated with controlling light output of gas-discharge lamps.

BRIEF DESCRIPTION OF THE DRAWINGS

Reference should be made to the following detailed description which should be read in conjunction with the following figures, wherein like numerals represent like parts.

DETAILED DESCRIPTION

Figure 1:
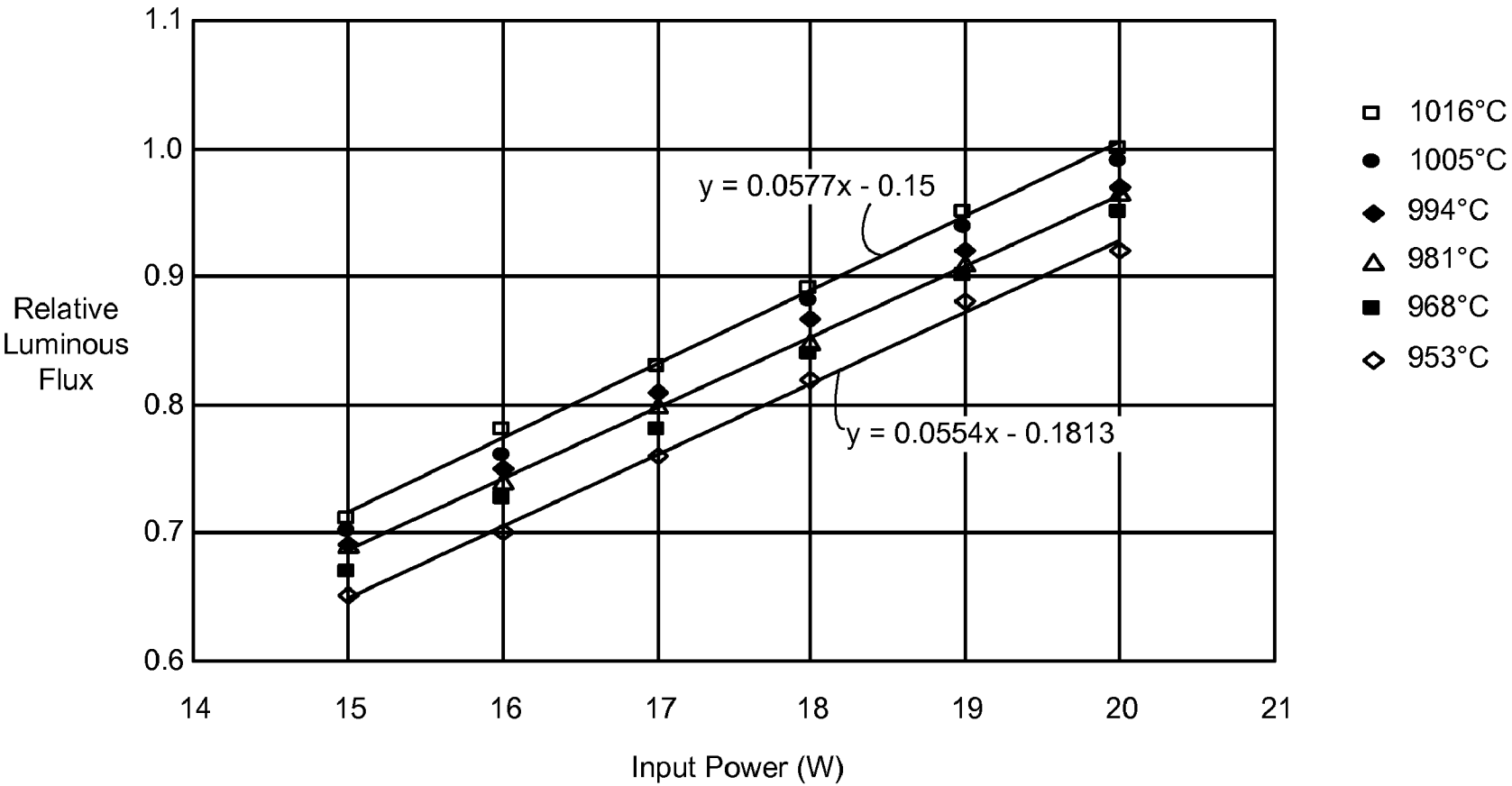
FIG. 1 illustrates an example light output vs. power (LO vs. P) mapping that can be used to estimate instantaneous lamp efficacy, in accordance with an embodiment of the present invention.

Techniques are disclosed for controlling light output of gas-discharge lamps such as metal halide lamps. The techniques can be applied in a broad range of operational scenarios, including run-up and hot relight. In addition, the techniques can also be used to control light output for any number of arbitrary light output vs. time schemes. The techniques can be implemented, for example, as a control algorithm for metal halide lamps and other gas-discharge lamps. The control algorithm can be implemented, for instance, in software and executed by a processor, to cause the issuance of commands to equipment that power the target lamp. Other embodiments may be implemented in hardware, or a combination of hardware and software.

General Overview

The light producing ability of a gas-discharge lamp can generally be described by a collection of light output vs. power curves, with each curve corresponding to a different lamp temperature. In this context, light output refers to brightness or lumen output of the lamp, and power refers to the input power at which the lamp is operated. In reality, the lamp temperature is not homogeneous, but can be described by a temperature profile or temperature distribution. For example, the lamp temperature may have a maximum near the middle of the arc tube and be less near the ends or capillaries. For computational convenience, lamp temperature can be described by a single value that corresponds to the maximum temperature on the arc tube outer surface, at or near the middle of the arc tube.

As previously explained, there are a number of non-trivial and subtle issues associated with controlling light output of gas-discharge lamps. In more detail, at higher lamp temperatures, the efficacy of the lamp is higher, as illustrated by the example light output vs. power curves shown in FIG. 1. In addition, for a given lamp temperature, lamp efficacy increases with instantaneous input power. In general, the efficacy of a lamp is the ratio of lumens to input power. The light output vs. power curves are relatively linear, which might at first imply a constant efficacy, but the lines do not pass through the origin of the graph.

Rather, an increase in input power leads to a higher than proportionate increase in light output. For example, the respective light outputs at input powers of 18 W and 20 W are more than 1.2 and 1.33 times the light output at an input power of 15 W. Once a light output vs. power description is established for a target lamp, then for a given lamp temperature and desired light output level, the required input power to obtain that light output can be determined. To track the lamp temperature, and in accordance with an embodiment of the present invention, a control algorithm is provided to track the input power applied to the lamp, which is the arc power, or input lamp voltage multiplied by input lamp current. In addition, the control algorithm can be configured to estimate the power losses of the lamp, which may include, for example, thermal radiation from the surface from the arc tube, conduction along the electrodes, and emitted radiation in the form of light (e.g., ultraviolet, visible). The net power available to heat up the lamp can then be computed as the difference between the input power and the power losses, and the net energy available to heat up the lamp is effectively the net power integrated over time. An estimate of the heat capacity of the lamp then allows the control algorithm to estimate how the lamp temperature is affected.

The control algorithm can be implemented in a number of ways, as will be appreciated in light of this disclosure. In one specific example embodiment, the control algorithm is programmed or otherwise configured to: sense lamp electrical data (e.g., input current and voltage vs. time); calculate or estimate power and energy inputs and losses based on sensed electrical data; estimate resulting lamp temperature based on power/energy inputs and losses; calculate the input power to be applied to the lamp based on the estimated resulting lamp temperature and a desired lamp output, and issue equipment commands to apply that refined input power and produce the desired light output. As is known, there are many ways by which power can be applied to a lamp, and the equipment/circuitry for applying the power can generally be implemented using conventional technology (e.g., ballasts, switching, etc). In addition to its conventional structure and functionality, the equipment/circuitry for applying the power can be further configured to operate in response to control commands issued by the control algorithm as explained herein.

For example, and in accordance with one example embodiment of the present invention, given an already operating lamp, one way of adjusting the lamp input power to the next desired target power is to scale the lamp current, since the lamp voltage changes relatively little with power. Any resulting difference, which is relatively small, between the actual and target power can then be addressed similarly in subsequent control loops, which gives satisfactory input power control. In some embodiments where greater accuracy is desired, the difference between actual and target power can be further reduced, and thus provide even faster power control, by estimating the slight voltage change with power. When igniting a lamp, an initial estimate of the lamp input voltage can assist with achieving the target power quickly. The estimated lamp input voltage can be dependent, for example, on the estimated lamp temperature.

For application to a lamp run-up scenario, and in accordance with one embodiment of the present invention, the desired light output can be set to 100% at all times. A cold lamp will generally have poor efficacy and require high power to produce full light output. The desired power may not be achievable due to a constraint on the allowed run-up current. In such cases, the lamp can initially run-up at the maximum allowed current. As the lamp warms and the efficacy and voltage increase, eventually full light output can be obtained. This can occur before the lamp is completely warm. The lower-than-rated lamp efficacy is compensated by a higher-than-rated applied input power. As the lamp continues to warm, the increasing efficacy must be balanced by decreasing the input power towards the rated or nominal level, in order to maintain the light output constant. In accordance with one such embodiment, the lamp control algorithm is able to determine the appropriate input power to apply to obtain the desired light output. The resulting run-up behavior of the lamp can be a constant current run-up at the maximum allowed current, until full light output is achieved. The light output is maintained at the rated level as the lamp continues to warm to steady state. The rated level, or full light output, is the steady state light output produced by a lamp operating at rated power. Note that full lumen output is reached prior to the lamp reaching steady state, which is advantageous if a fast run-up is desired. If the light output vs. power description of the lamp becomes less accurate at lower temperatures, the lamp efficacy can be estimated during early run-up as a function of temperature only, in accordance with one embodiment of the present invention. To this end, a threshold temperature $T_{threshold}$ can be established that defines when the efficacy switches from a function of temperature only, to a function of both temperature and input power.

For application to a lamp hot relight scenario, and in accordance with one embodiment of the present invention, the control algorithm can be configured to run even when the lamp is off. When the lamp is off, the net energy flow to the lamp may be negative (where there is no power input, only losses). The control algorithm in this example case can be configured to track the lamp temperature as the lamp cools. When the lamp is relit, the control algorithm calculates the appropriate input power so that rated (or other target) light output is produced. Generally, if the lamp has cooled from steady state and the efficacy is thus reduced, this means the required input power is elevated from what it would be at steady state. Again, as the lamp warms up and its efficacy increases, the applied input power can be decreased to maintain a constant light output. The result for the end user is a hot relight of the lamp which produces the desired amount of light, while avoiding underlighting, overlighting, and unnecessary power to the lamp. In the case where the lamp has cooled so much that the required current to obtain the target light output exceeds the maximum allowed operating current, then the lamp operates as if running up from a cold lamp, with a constant current run-up at maximum allowed current until the target light output is reached. The run-up time in this particular case can generally be reduced from that of a cold lamp, if the lamp has not completely cooled.

The lamp temperature profile of a lamp which is off and cooling is likely to have smaller gradients than when the lamp is on. For example, the condensate temperature for a lamp that is off is likely to be higher than for a lamp that is on, given the same maximum external surface temperature. Upon relight, the lamp efficacy as a function of maximum external surface temperature is likely to be higher. In accordance with an embodiment of the present invention, a correction factor can be used to improve the estimate of light level obtained upon relight of the cooling lamp. One way of implementing such a correction factor is to multiply the estimated lamp temperature immediately prior to relight by a temperature profile adjustment factor (TPAF). The adjusted lamp temperature can then be used to determine the applied input power upon relight of the lamp.

In accordance with some embodiments of the present invention, the desired light output can be set to values other than 100% (full rated value). For example, run-up and relight can be targeted at 80% light output. In general, any desired light output value can be set, depending on the given application. The desired light output can also be varied as a function of time to produce arbitrary or custom light output vs. time paths. By providing the desired light output to the control algorithm (e.g., via a control knob or electrical signal, or any other suitable input mechanism), then the arbitrary light output vs. time path can be generated on-demand, as the control calculations can be done in real-time or spontaneously as the desired light output levels are input. Determination of the applied input power vs. time required to obtain the desired light output vs. time need not be done in advance.

Figure 2A:
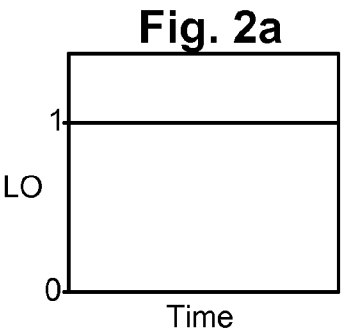
FIGS. 2*a-h* demonstrate example light output vs. time paths that can be implemented in various scenarios, including run-up, hot relight, ramp dimming, step dimming, and other arbitrary shaped paths, in accordance with an embodiment of the present invention.
Figure 2B:
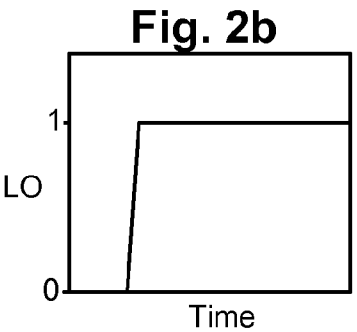
Figure 2C:
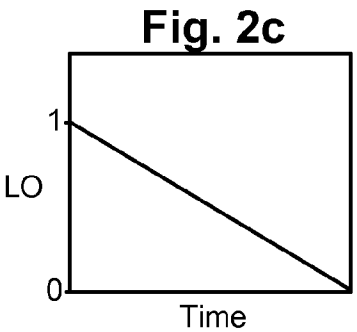
Figure 2D:
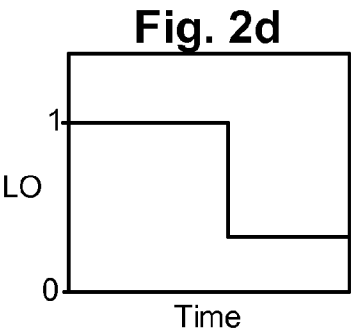
Figure 2E:
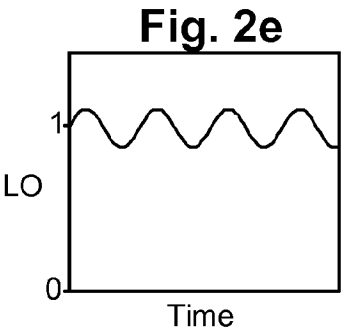
Figure 2F:
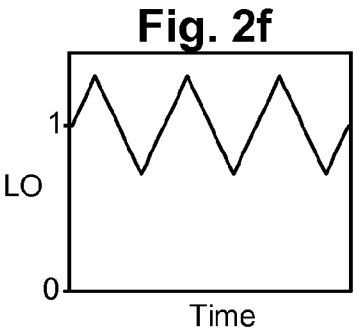
Figure 2G:
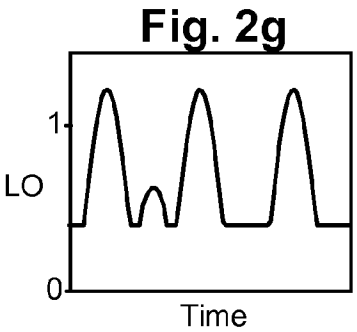
Figure 2H:
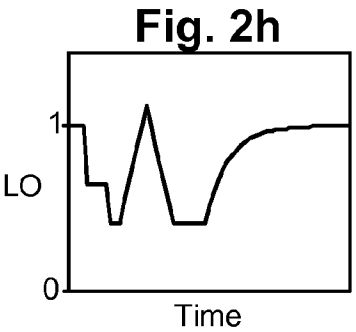

Graphs demonstrating example arbitrary light output vs. time paths that can be implemented by the control algorithm are provided in FIGS. 2*a* through 2*h*. The ability to estimate the instantaneous efficacy of a lamp in general allows the control algorithm to produce arbitrary light output vs. time paths, for which run-up and hot relight are specific examples, as shown in FIGS. 2*a* and 2*b*, respectively. As can be seen, the run-up path shown in FIG. 2*a* is essentially a constant full light output (LO) path (subject to maximum allowed currents which may limit applied power), while the light output vs. time path for hot relight as shown in FIG. 2*b* is a step function from zero. FIG. 2*c* demonstrates an example light output vs. time path for ramp dimming, and FIG. 2*d* demonstrates an example light output vs. time path for step dimming. Other example light output vs. time paths include a sine wave shaped path (FIG. 2*e*), a triangle wave shaped path (FIG. 2*f*), and any number of irregular or otherwise arbitrary shaped paths (FIGS. 2*g* and 2*h*).

Situations (in addition to run-up and hot relight scenarios) in which such spontaneous light output control might be particularly useful include, for example: those situations in which the lamp is operating out of steady state, generally when the desired light output changes are on a time scale that is short relative to the time it takes for the lamp to reach thermal equilibrium, such as during dimming; and those situations in which custom or spontaneous requirements for light output are desired, such as for stage lighting or when the lamp is used in manufacturing or processing (e.g., such as a UV curing process for a deposited epoxy).

Thus, the control algorithm can be configured for controlling run-up of a lamp based on electrical feedback only, which can readily accommodate run-up to a selectable light output as well as run-up from partially warm lamps, if the lamp temperature is known (e.g., based on measurement or estimation). The control algorithm can also be configured for controlling lamp power upon relight, which can readily accommodate hot relight to a selectable light output, and does not require the assumption that the lamp was at steady state when shut off. The control algorithm can also be configured to control light output for arbitrary light output vs. time. In one such embodiment, the desired light output vs. time behavior can be obtained on-demand, as the control calculations are done in real-time. The time scale of lamp control enabled by the techniques described herein is generally faster than the thermal equilibration time for the lamp, so that light output control is obtained without having to wait for the lamp to reach steady state. Numerous beneficial light output control schemes based on lamp temperature and/or input power will be apparent in light of this disclosure.

Example Lamp Structure

Figure 3:
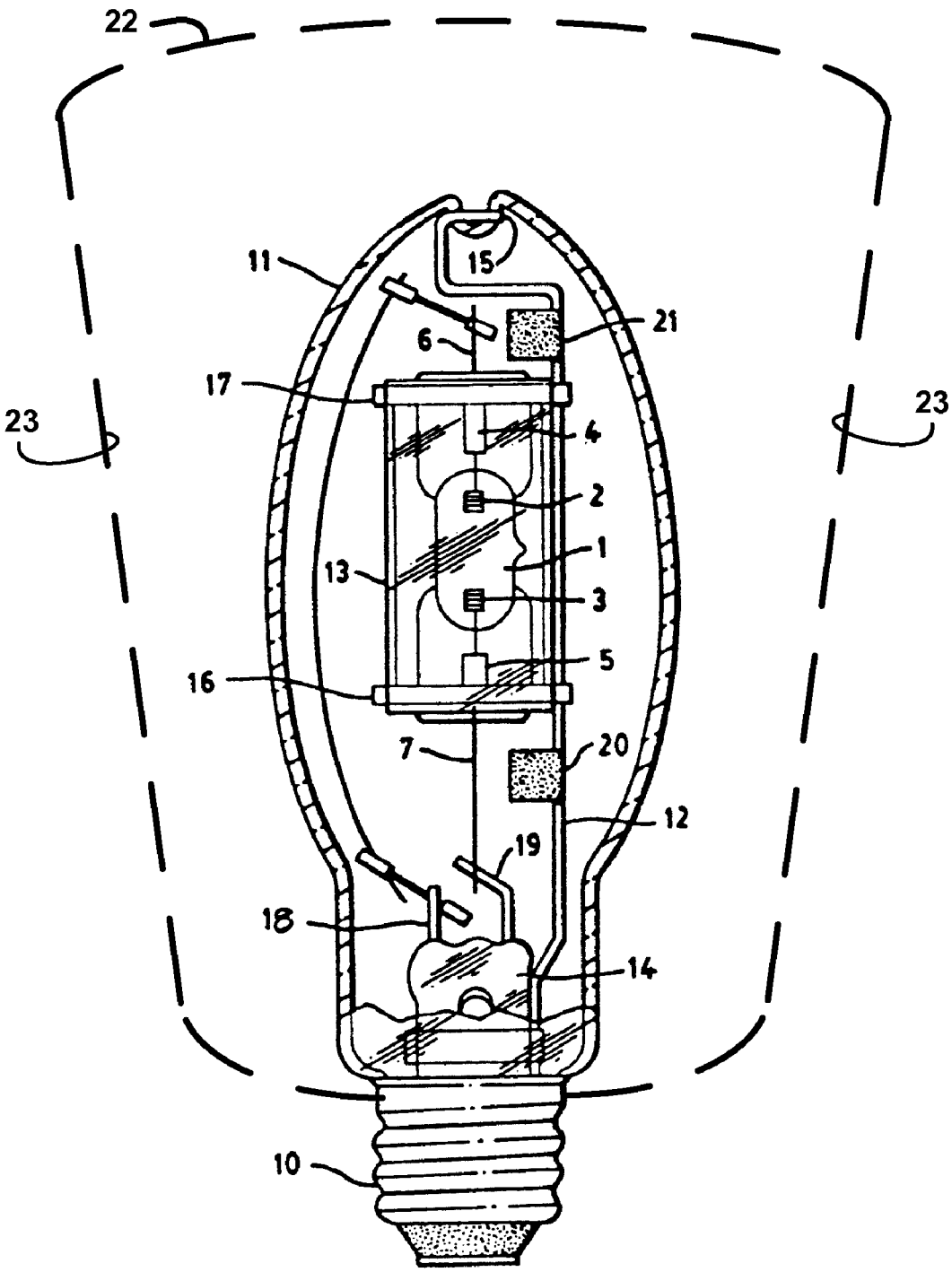
FIG. 3 illustrates an example metal halide lamp that can be controlled in accordance with an embodiment of the present invention.

FIG. 3 illustrates an example metal halide lamp that can be controlled in accordance with an embodiment of the present invention. This example lamp structure is intended to represent a broad range of lamps, and the claimed invention is not intended to be limited to any particular lamp configuration. Rather, the light output control techniques provided herein can be used with most lamp configurations where it is desirable to control light output by estimating lamp efficacy as a function of temperature and/or instantaneous input power. Numerous alternative lamp types and configurations, as well as various combinations of conventional lamp features, structures, and materials, will be apparent in light of this disclosure.

The example lamp shown includes an arc tube 1 disposed within an outer sealed glass envelope or jacket 11. As previously explained, the lamp temperature may have a maximum near the middle of the arc tube and be less near the ends or capillaries. For computational convenience, lamp temperature in this example case is described by a single value that corresponds to the maximum temperature at or near the middle outer surface of the arc tube 1. The outer jacket 11 is evacuated and hermetically sealed to an affixed glass stem member 14 having an external base member 10. A pair of electrical conductors 18 and 19 is sealed into and passes through the stem member 14. The arc tube 1 has a pair of electrodes 2 and 3 which project into the interior of the arc tube 1 at respective ends and provide for energization of the discharge lamp by an external power source during operation. Arc tube 1 may generally be made, for instance, of quartz, although other types of suitable materials may be used such as alumina, aluminum nitride, aluminum oxynitride or yttrium aluminum garnet. Each electrode 2 and 3 includes a core portion surrounded by, for example, molybdenum or tungsten wire coils. Each of the electrodes 2 and 3 in this example lamp configuration is connected to respective metal foils 4 and 5, which are pinch sealed and can be formed of, for example, molybdenum. Electrical conductors 6 and 7, which are electrically connected to respective foils 4 and 5, extend outwardly of the respective press seals. Conductors 6 and 7 are respectively connected to the conductors 18 and 19 projecting from the glass stem member 14. As can be further seen, the connection between conductor 6 and conductor 18 in this example lamp configuration is made by a vertically disposed wire extending exterior to the radiation shield (shroud) 13. A pair of optional getters 20 and 21 are mounted to the support structure 12. Recall that getters can be utilized to maintain the vacuum in the outer envelope of a lamp.

The arc tube 1 is positioned inside the shroud 13 and is electrically isolated from the shroud 13 and the support structure 12. Such a "floating frame" structure can be used to control the loss of alkali metal from the arc tube 1 fill by electrically isolating the support structure 12. Example floating frame structures are further described in U.S. Pat. Nos. 5,057,743 and in 4,963,790, each of which is incorporated herein by reference in its entirety.

The shroud 13 is secured to the support structure 12 by spaced apart straps 16 and 17 which can be respectively welded or otherwise coupled to a vertically aligned portion of the support member 12. The shroud 13 of this example lamp configuration has a cylindrical shape and may be in the form of, for instance, a quartz sleeve which may or may not have a domed shaped closure at one end. Each of the straps 16 and 17 can be made of a spring-like material so as to grippingly hold the shroud 13 in position. As described in U.S. Pat. No. 4,859,899, which is incorporated herein by reference in its entirety, the diameter and length of shroud 13 may be chosen with respect to the arc tube 1 dimensions to achieve an optimal radiation redistribution resulting in uniform arc tube 1 wall temperatures.

Base 10 may be implemented, for example, with a mogul-type base, e.g., such as an E27 screw base. Note, however, that the lamp may have a medium base or double-ended configuration, or any number of suitable bases or interfaces that allow for electrical connection to a power source. The lamp may also include other structural features commonly found in metal halide gas-discharge lamps, or other such lamps. For instance, the lamp may include an auxiliary starting probe or electrode (e.g., generally made of tantalum or tungsten) which may be provided at the base end of the arc tube adjacent the main electrode 3.

In one example case, the arc tube 1 contains a chemical fill of inert starting gas, mercury, alkali metal iodides, and scandium iodide. In dispensing the chemical fill into the arc tube of a lamp, the non-gaseous components can beneficially be dispensed into the unsealed arc tube 1 prior to introduction of the starting gas. As is now known, a charge of mercury is present in a sufficient amount so as to enhance the electrical characteristics of the lamp by desirably reducing the amperage requirements needed to sustain a desirable discharge in the arc tube 1. In addition to mercury, a small charge of an inert ionizable starting gas such as argon may be contained within the arc tube 1. Note, however, that other noble gases can be substituted for argon provided an appropriate pressure is maintained that is conducive to starting the lamp and minimizing electrode sputtering or evaporation.

Further details on one type of lamp that can be utilized in conjunction with the optional getters 20 and 21 is described in U.S. Pat. No. 4,709,184, which is incorporated herein by reference in its entirety. The lamp described there utilizes scandium iodide and the alkali metal iodides are present as the chemical fill and in the discharge gas during lamp operation. In one particular such configuration, the ingredients of scandium iodide and the alkali metal iodides are present in a ratio which provides a warm color of lamp light output comparable to the output of an incandescent lamp. As will be appreciated in light of this disclosure, embodiments of the present invention may be utilized with lamps containing any number of suitable chemical fills.

The wall temperature arc tube 1 is dependent on multiple factors such as light transmissive properties, diameter, length, and wall thickness of the arc tube 1. Providing an evacuated outer jacket 11 tends to increase the cold spot temperature. In one example case, the cold spot temperature of the arc tube 1 is from about 800° C. to about 1000° C. Note, however, that the claimed invention is not intended to be limited to any particular range of arc tube temperatures or arc tube types, as will be appreciated in light of this disclosure.

The tendency of the lamp to discolor can be reduced by the inclusion of the getters 20 and 21 in the evacuated envelope 11. The getters 20 and 21 can be secured to a ferrous metal backing which in the example lamp configuration shown can be secured to the support structure 12 by welding or other suitable attachment technique. The outer envelope 11 of the assembled lamp can be subjected to vacuum through a tubulation that is located in the base 10 of the lamp. Prior to evacuation, the outer envelope 11 may be purged with an inert gas to remove reactive gases such as oxygen. The purge and evacuation can be performed, for instance, at oven baking temperatures so that moisture present in the envelope is also evacuated. Additional details regarding example getter materials are provided in U.S. Pat. No. 5,327,042, which is incorporated herein by reference in its entirety. Note, however, that other lamp configurations may not include getters 20 and 21.

Also shown in FIG. 3, is a housing (generally shown in dashed lines) in which the thus far described light source included within the outer jacket 11 may be enclosed, thereby providing a reflector lamp configuration. As can be seen, the housing generally includes reflective inner walls 23 and a lens 22 for outputting light from the light source. The lens 22 can be attached to the forward edge of the reflector walls 23 to enclose the light source included within the outer jacket 11. The lens 22 may be fused, glued, or similarly coupled to the reflector walls 23 as typically done. The reflector walls 23 have an internal reflective surface to reflect the light emitted from light source included within the outer jacket 11. Additional example details of such reflector lamp configurations are provided in U.S. Pat. No. 7,030,543, which is incorporated herein by reference in its entirety.

Numerous other lamp structures that can benefit from light output control as described herein will be apparent in light of this disclosure. For instance, example ceramic metal halide lamps are described in U.S. Pat. No. 7,256,546, and example quartz metal halide lamps are described in U.S. Pat. No. 5,694,002. Each of these patents is incorporated herein by reference in its entirety.

Light Output v Power (LO v P) Map

As previously explained with reference to FIG. 1, the light output of the lamp can be mapped or otherwise described by a set of light output (LO) vs. power (P) curves, with a different curve for each lamp temperature of interest. A single LO vs. P curve at a particular temperature can be determined, for example, empirically by operating an unjacketed burner in a bell jar and measuring (P, LO) data pairs while holding the lamp temperature fixed. For each (P, LO) data pair, the lamp is first set to the desired lamp temperature by operating the lamp at that power which results in the desired temperature at steady state. Once the steady state temperature is reached, the lamp power can be stepped (up or down) through a range of power levels of interest, whereupon a (P, LO) data pair can be recorded for each such power level, before the lamp has a chance to warm or cool significantly (e.g., as determined by a given tolerance, such as 10° C. or less of change). This process can be repeated for any number of steady state temperatures, so as to provide a set of LO vs. P curves as shown in FIG. 1. In other embodiments, the LO vs. P maps can be determined based on theoretical analysis or otherwise derived from known information (no measurement required), assuming such theoretical maps will provide the desired degree of accuracy.

For purposes of further discussion, assume the lamp that generated the curves shown in FIG. 1 is a 20 W HCI POWERBALL lamp (MC20TC/U/G8.5/830, produced by OSRAM Sylvania Inc). As will be appreciated, any gas-discharge lamp can be used to generate an LO v P map (or set of LO vs. P data curves) as described here in, and the claimed invention is not intended to be limited to any particular lamp or set of lamps. A light output of unity (LO=1) corresponds to that obtained by a lamp running in steady state at rated power. To determine light output at temperatures other than those actually measured, the measured LO vs. P curves shown in FIG. 1 can be approximated as lines so that LO=Slope*P+Intercept, with Slope and Intercept being functions of temperature. In the example graph shown in FIG. 4, the Slope and Intercept are plotted vs. temperature.

The dependence of Slope and Intercept on temperature can be approximated by linear functions as well, so that: Slope=$A*T_C+B$; and Intercept=$C*T_C+D$. Substituting these equations into the LO equation gives: LO=$(A*T_C+B)*P+(C*T_C+D)$. Continuing with the example shown in FIGS. 1 and 4, A=3.74E-05, B=1.97E-02, C=4.39E-04, and D=−5.94E-01 for the lamp temperature $T_C$ given in degrees Celsius and the power P given in watts. Given this description of the light generating ability of the lamp, the instantaneous LO of a lamp can then be estimated and controlled if the lamp temperature is estimated or otherwise tracked. The normalized efficacy η, which is a function of lamp temperature and input power, can be expressed as $\eta(T,P)=P_n*LO(T,P)/P$, where $P_n$, is the nominal input power (20 W in this example case), P is the actual input power, and LO(T,P) is the normalized light output (unity at $P_n$).

If the LO vs. P description of the lamp become less accurate at lower temperatures, the efficacy during early run-up can be estimated as a function of temperature only. In accordance with one such example embodiment, below a given threshold temperature ($T_{threshold}$), the lamp efficacy η can be estimated as shown in Table 1. As can be seen, the given $T_{threshold}$=820° C. in this example, but other suitable threshold temps can be used.

TABLE 1

| Lamp Temp ($T_C$) Range | Normalized Lamp Efficacy |
|---|---|
| For $T_c < 100°$ C. | $\eta = 0.03$ |
| For 100° C. <= $T_c$ < 410° C. | $\eta$ rises linearly with $T_c$ from 0.03 to 0.08 |
| For 410° C. <= $T_c$ < 820° C. | $\eta$ rises linearly with $T_c$ from 0.08 to 0.8 |

As will further be appreciated in light of this disclosure, whether efficacy is estimated as a function of temperature and power, or as a function of temperature only can depend on any number of changes in the operating scenario of the lamp, or as otherwise desired for a given lamp application. For instance, lamp efficacy may be estimated as a function of temperature and power for lamp temperatures within a certain range, and as a function of temperature only when the lamp temperature is either above or below that range (in this example case, note that there could be two threshold temperatures, $T_{threshold_1}$ and $T_{threshold_2}$). In another example case, lamp efficacy may be estimated as a function of temperature and power only on weekdays during the hours between 8 am and 8 pm, and as a function of temperature only during non-business hours. Thus, transitioning from one mode of operation ($\eta$ estimated as function of temperature+power) to another mode of operation ($\eta$ estimated as function of temperature only) can be based on lamp parameter data (e.g., temp, etc), non-lamp parameter data (e.g., day/time, etc), or both. Numerous other scenarios will be apparent in light of this disclosure, and the claimed invention is not intended to be limited to any particular one.

Note that in some example embodiments, efficacy can be estimated as a function of temperature only for all operational scenarios, if so desired. In one such case, the lamp temperature ranges from 0° C. to 1000° C., but other ranges may be applicable depending on factors such as the lamp being used, the duration for which the lamp is run and at what power, and the environment in which the lamp is run. In other example embodiments, efficacy can be estimated as a function of temperature and power for all operational scenarios, if so desired.

Control Parameters for Tracking Lamp Temperature

Lamp temperature can be tracked by energy balance equations. In more detail, the input power to the lamp $P_{lamp}$ is the product of the lamp input current and lamp input voltage. Depending on factors such as desired accuracy and nominal range of lamp temperature, any number of power loss components can be considered. In one example embodiment, four power loss components are considered as will be discussed in turn. Other embodiments may consider a sub-set of these loss components, or other relevant loss components. Each of the four example power loss components will now be discussed in more detail.

Figure 5:
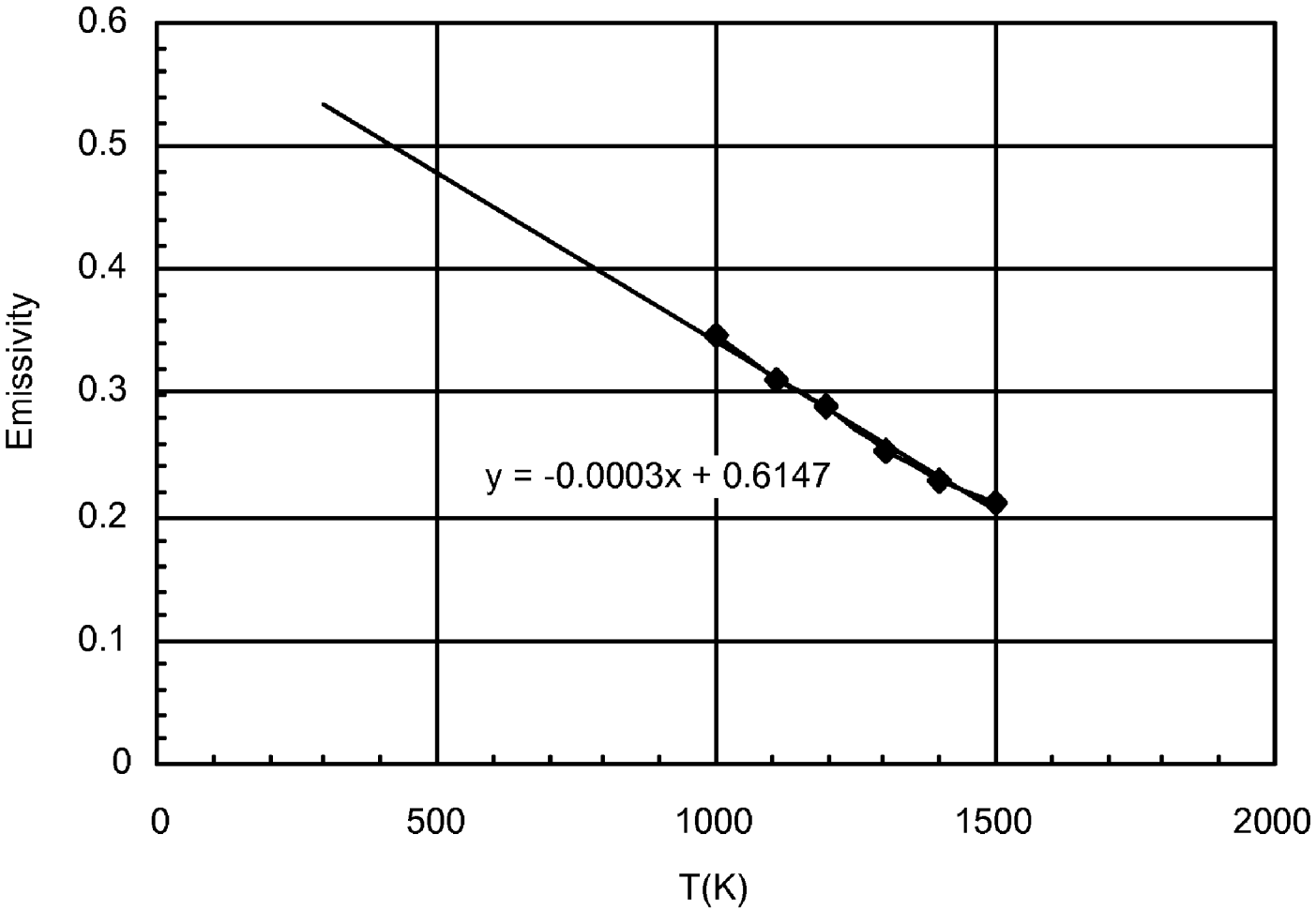
FIG. 5 illustrates example emissivity e of an alumina arc tube as a function of $T_K$.

During steady state operation at nominal power, the largest power loss component is blackbody-like radiation from the surface of the arc tube, $P_{rad}=C_{rad}*e(T_K)*[(T_K)^4-(T_{amb,K})^4]$, where $T_K$ and $T_{amb,K}$ are the lamp temperature and the ambient temperature respectively, in kelvins. The emissivity e is a function of $T_K$, as best shown in FIG. 5, which illustrates emissivity of an example polycrystalline alumina (PCA) arc tube. The constant $C_{rad}$ includes such factors as the Stefan-Boltzmann constant $\sigma$ and the size/surface area of the lamp and its magnitude can be determined, for example, from infrared camera wall temperature measurements on an unjacketed arc tube running in a bell jar, as will be described in turn.

The second largest or otherwise significant power loss component is emitted visible radiation, which can be approximated as: $P_{vis}=P_{lamp}*\eta*0.36$, where the normalized efficacy $\eta$ can be dependent on instantaneous discharge power and lamp temperature, or on lamp temperature alone, and has a value of 1 at steady state operation at nominal power. The factor 0.36 reflects the observation that for lamps of interest in steady state operation at nominal power, the fraction of lamp power emitted in the visible is about 36%. In other example cases, estimates of $P_{vis}$ can be improved by making the factor 0.36 a function of lamp temperature or input power.

Figure 6:
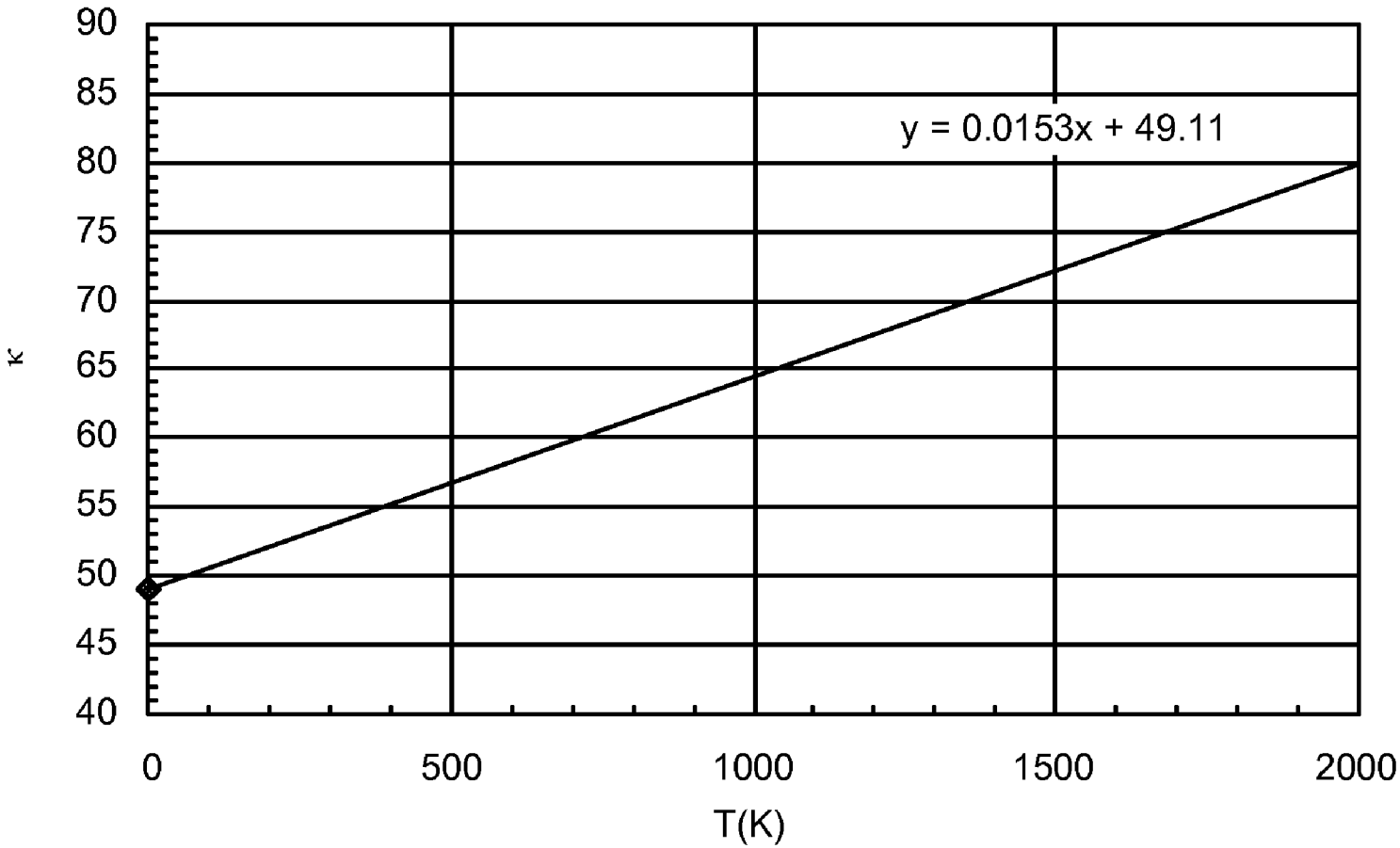
FIG. 6 illustrates example temperature dependence of thermal conductivity η for niobium lead wires.

The third largest or significant power loss component is conduction along the lead wires: $P_{con}=C_{con}*\kappa(T_K)*(T-T_{amb})*K_2(P)$, where the effect of physical dimensions and composition of the lead wire are included in $C_{con}$. The temperature dependence of the thermal conductivity $\kappa$ is included for generality but may not be necessary as the dependence is small and $P_{con}$ is also somewhat small compared to the first two energy loss terms. Continuing with the 20 W HCI POWERBALL lamp example, and with reference to FIG. 6, $\kappa(T_K)$ was modeled after that of niobium (W $m^{-1}$ $K^{-1}$), a common material from which lead wires are made. The factor $K_2(P)$ describes the enhancement of the conductive loss at higher discharge powers. The values of $C_{con}$ and $K_2(P)$ can be determined in a calibration/fitting procedure to be described in turn which utilizes lamp wall temperature data taken, for example, by a thermal imaging camera or other suitable temperature reading apparatus.

The fourth energy loss term that can be considered is: $P_{oth}=P_{lamp}*0.04$, which includes ultraviolet (UV) and infrared (IR) emission that escapes the arc tube without heating it. The 4% estimate can be used as a starting point, and can be adjusted and given a temperature dependence as data becomes available.

For each calculational loop, the net power to the arc tube can be determined by subtracting these four power losses (or subset thereof) from the input power to the lamp. Integrating over the loop time, the net energy flow $E_{net}$ can be determined. The resulting change in lamp temperature $\Delta T$ is then: $\Delta T=E_{net}/C_p(T_K)$, where the heat capacity $C_p(T_K)$ can be further separated into a function containing the temperature dependence and a scaling factor which corresponds roughly to the heat capacity at ambient temperature, as in $C_p(T_K)=C_{p20}*f(T_K)$.

Figure 4:
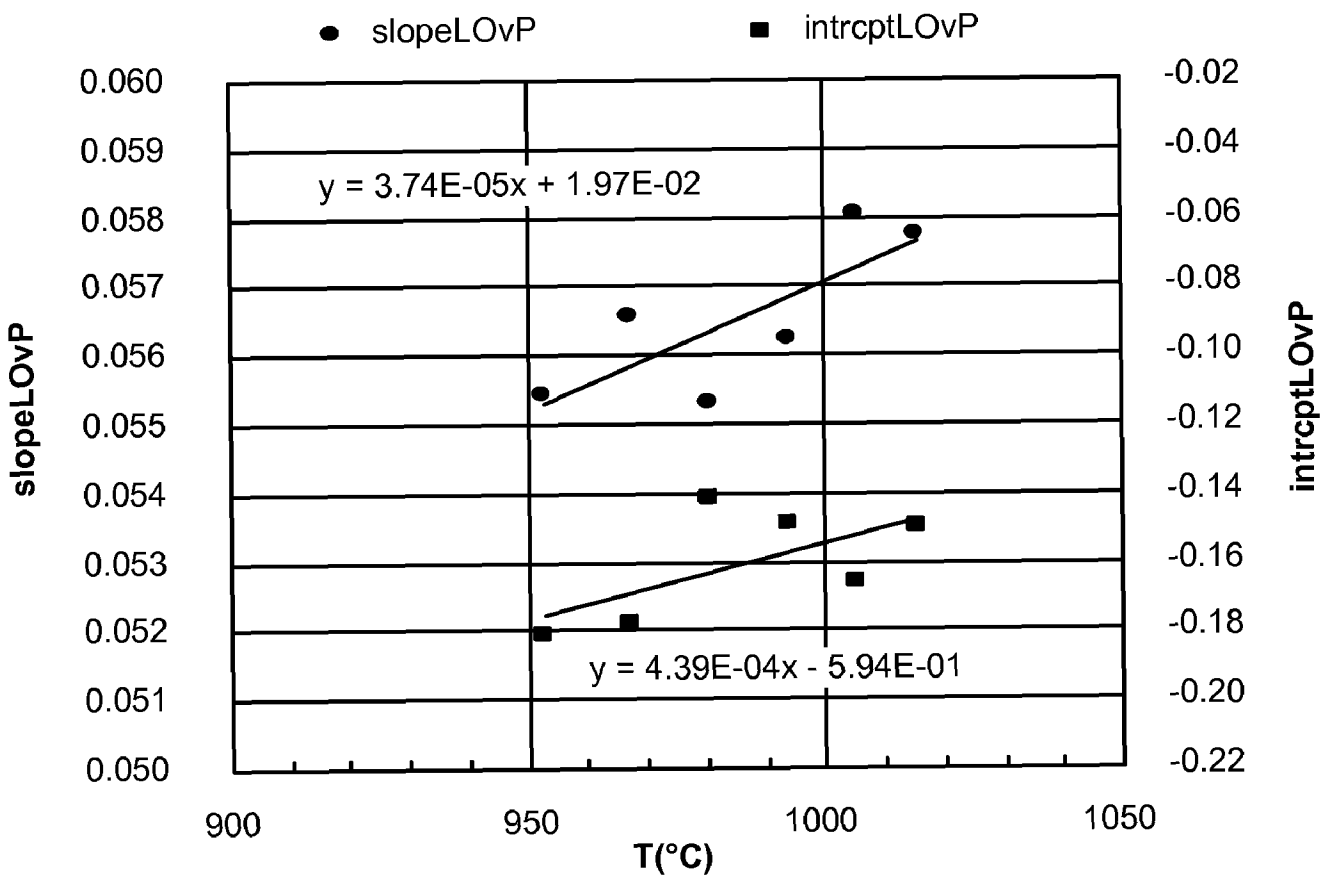
FIG. 4 shows Slope and Intercept plotted vs. temperature and illustrates how the measured LO vs. P curves making up the light output vs. power mapping shown in FIG. 1 can be approximated as lines so that LO=Slope*P+Intercept, with Slope and Intercept being functions of temperature.
Figure 7:
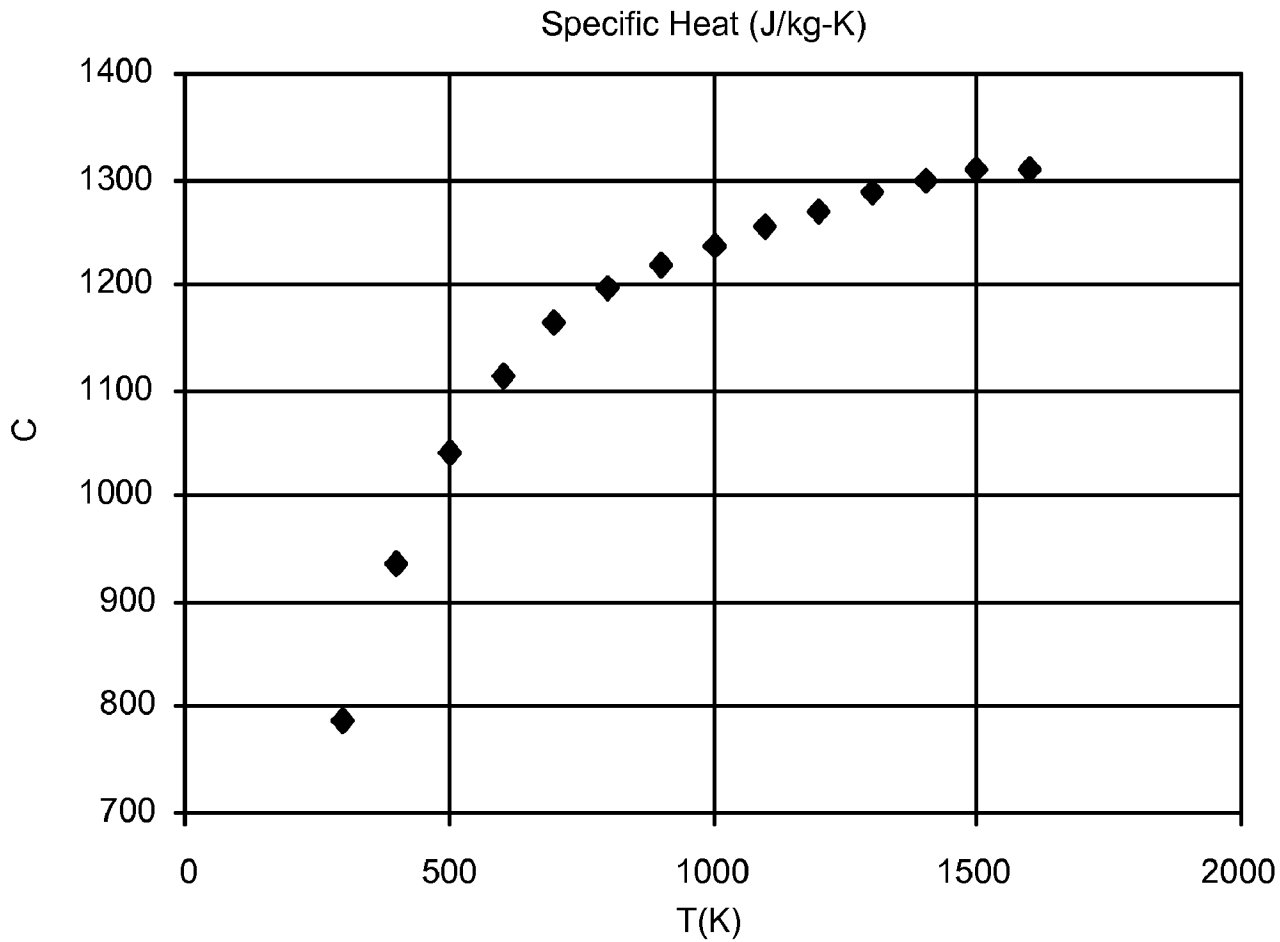
FIG. 7 illustrates example temperature dependence of the specific heat of alumina.

For example, and with continuing reference to the 20 W HCI POWERBALL lamp example of FIGS. 1 and 4, $f(T_K)=[40.92+4.024*T-(5.0048E-03)*T^2+(2.8852E-06)*T^3-(6.2488E-10)*T^4]/789$, which has been scaled to equal 1 at 300K. As can be seen with reference to FIG. 7, the temperature dependence of the heat capacity of the lamp was scaled from the specific heat of alumina, which is a typical material from which ceramic metal halide arc tubes are made (e.g., PCA).

To help determine values for the various control parameters detailed herein, an unjacketed arc tube of the lamp type of interest can be operated in a bell jar which allows simultaneous collection of lamp data: electrical data including lamp voltage (V), lamp current (I), and lamp input power (P, which equals V×I); light data such as lumen output and efficacy; and lamp temperature data. These measured lamp data values can be obtained (measured) during different scenarios, including: during run-up operation, during cool off following power interruption, and during steady state operation at dimmed powers. The lamp control parameters of interest can then be subsequently selected to match or otherwise fitted to the aggregate of measured lamp data values. In this way, one set of best-fit control parameters can be used, regardless of the operating scenario of the lamp.

In particular, the lamp control parameter values of $C_{rad}$, $C_{con}$, and $C_{p20}$ can be adjusted/selected to get reasonable agreement (best fit or other suitable matching criteria) with the lamp data values (V, I, P, light data such as lumen output and efficacy; and lamp temperature data) measured during run-up, cooling, and steady state (nominal and dimmed) operation. In general, and in accordance with one example embodiment of the present invention, radiation losses from a steady state lamp are in the 50-60% range, while conduction losses are much less, in the 10-20% range. The steady state temperature is strongly affected by $C_{rad}$, while $C_{p20}$ affects the shape of the lamp temperature vs. time curve during run-up. $C_{rad}$ and $C_{con}$ can be adjusted in opposite directions to get the same steady state temperature, but there is an upper limit to $C_{rad}$ as then it would be impossible to match the lamp temperature vs. time cooling behavior. During lamp cooling, there is no energy input and the only energy losses are radiation and conduction. For a given $C_{p20}$, there is then a maximum limit to $C_{rad}$. Allowing $C_{con}$ to vary with the lamp input power $P_{lamp}$ allows the best agreement to observed data during run-up, cooling, and steady state dimmed operation.

In accordance with one example embodiment, a general procedure is to make an initial estimate of $C_{rad}$, keeping in mind the maximum value consistent with lamp cooling behavior as previously described. Then determine the conduction loss that would be required to match the observed cooling behavior of the lamp at $P_{lamp}=0$, as well as the conduction losses required to obtain the observed lamp temperatures at various steady state powers (both nominal and dimmed). For convenience, the enhanced conduction loss at higher powers is calibrated or otherwise fit to a form: $K_2(P)=1+C_{K2}*(P-P_0)^2$, where $C_{K2}$ is a constant. Successive estimates of $C_{rad}$ can be made to produce an alternative group of model lamp control parameters, and evaluations made as to which group of model lamp control parameters works best overall at reproducing the observed (measured) lamp behavior.

The above considerations allow reasonable values of control parameters to be established, and the control algorithm can be implemented, for example, in a LabVIEW program or other suitable software programming environment for lamp operation in the laboratory. Alternatively, the control algorithm can be implemented, for example, in an electronic ballast configured with a processor. The processor can be implemented in hardware (e.g., gate-level logic or purpose-built silicon configured for carrying out the control algorithm functionality described herein), or a combination of hardware and software (e.g., microcontroller configured with a number of embedded routines for carrying out the control algorithm functionality described herein). In other embodiments, the processor may be a discrete stand-alone module that operatively couples to a lamp ballast or other such lamp power circuit. In any such cases, the processor can be configured with input/output capability so that it can receive input on parameters of interest (e.g., lamp and room temperatures, lamp input voltage and current, lamp light output, etc), and can output appropriate control signals or other desired commands. The algorithm executed by the processor constantly keeps track of lamp temperature (e.g., by way of estimation based on observed parameters) so that the corresponding efficacy and thus required input power to obtain the target light output can be determined and applied (subject to any current limits).

For the 20 W HCI POWERBALL lamp example of FIGS. 1 and 4, the following apply: $C_{rad}$=1.33E-11 (W $K^{-4}$); $C_{con}$=1.68E-05 (m); $C_{K2}$=5.89E-03 ($W^{-2}$); $P_0$=1 (W); and $C_{p20}$=0.31 (J $K^{-1}$). An example temperature profile adjustment factor (TPAF) that can be applied to this lamp is one which depends on the time $t_{off}$ since the lamp was turned off. The adjusted lamp temperature which should be used to determine applied power upon relight is the last calculated lamp temperature (in ° C.) multiplied by the TPAF as shown here: $TPAF=1+(TPAF_{max}-1)[1-\exp(-t_{off}/tau_{OFF})]$, where $TPAF_{max}$ and $tau_{OFF}$ are constants specific to target lamp type. For continued improved LO control after relight, the TPAF can gradually return to the steady state value of 1 as a function of $t_{on}$ since the lamp was relit: $TPAF=1+(TPAF_{max}-1)[\exp(-t_{on}/tau_{ON})]$. For the 20 W HCI POWERBALL lamp example, a $TPAF_{max}$ of 1.14 and set $tau_{OFF}$ and $tau_{ON}$ both equal to 20 seconds can be used.

As will be appreciated in light of this disclosure, the control method may be applied to POWERBALL lamps of other wattages, as well as other types and shapes of metal halide lamps. For instance, other example embodiments may have variations in metal halide salts, buffer gas pressure, Hg dose, and envelope material. Other embodiments include applying the control techniques provided herein to Hg-free metal halide lamps. The general principles of the control method can be applied to mercury, sodium, and other types of lamps. The control parameters may vary based on the target lamp type.

Control System and Algorithm

Figure 8B:
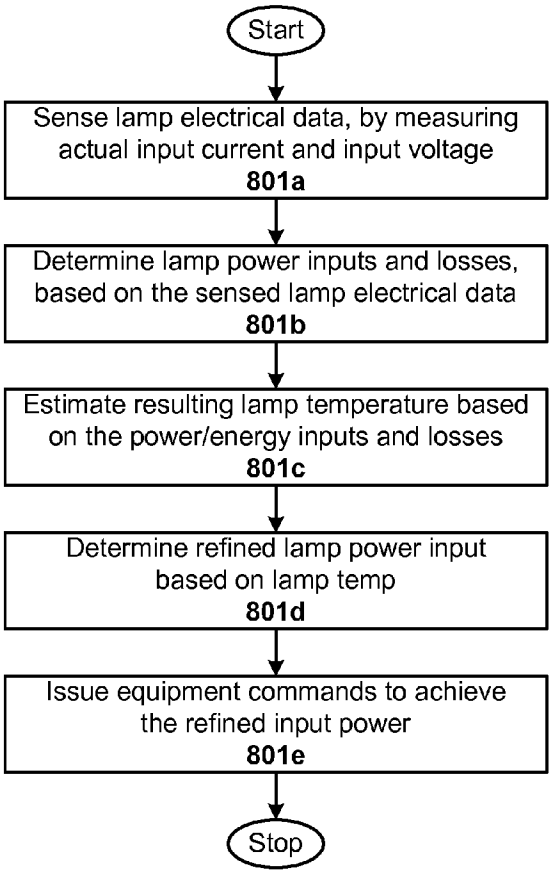
FIG. 8*b* illustrates a method for controlling the light output of a lamp, in accordance with an embodiment of the present invention.
Figure 8A:
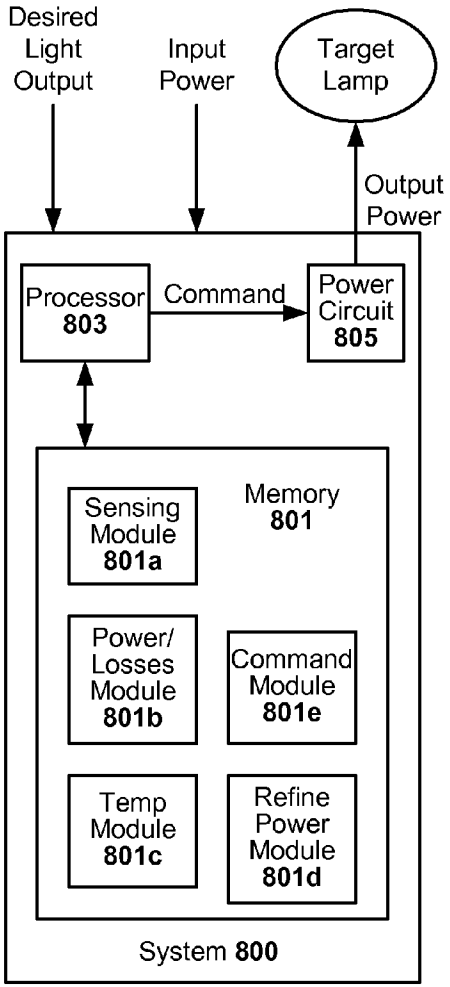
FIG. 8*a* illustrates a system for controlling the light output of a lamp, in accordance with an embodiment of the present invention.

FIG. 8*a* illustrates a system for controlling the light output of a lamp, in accordance with an embodiment of the present invention. As can be seen, the system 800 includes a memory 801, a processor 803, and a power circuit 805. The memory 801 includes a number of functional modules, including sensing module 801*a*, power/losses module 801*b*, temperature (temp) module 801*c*, refine power module 801*d*, and command module 801*e*. Other conventional componentry and/or functionality not shown will be apparent in light of this disclosure (e.g., busses, storage mechanisms, co-processor, graphics card, operating system, display, user input mechanisms, etc). The system 800 receives a desired light output input as well as input power, which powers the various component of system 800, and from which the output power is derived, based on commands generated by the processor 803 in response to execution of the various modules of memory 801.

A user can specify a desired light output, and the system 800 will adjust the target lamp light output in real-time to satisfy the user request within a given tolerance (e.g., +/−10% of target LO, or better). In other embodiments, the desired light output can be provided automatically and without user intervention (e.g., based on an established schedule or process that defines specific light outputs at different times). As will be appreciated the physical components of system 800 can be implemented with conventional technology, including processor 803 (e.g., Intel® Pentium® class processors, or other suitable microprocessors) and memory 801 (e.g., any RAM, ROM, cache, or combination thereof typically present in a computing device). Power circuit 805 may also be implemented with conventional technology, such as a programmable ballast circuit or other suitable mechanism capable of receiving a command signal and outputting a corresponding power level. In one embodiment, the power circuit 805 is configured to adjust the lamp current, based on the received command signal, thereby providing the desired output power.

Each of the modules (sensing module 801*a*, power/losses module 801*b*, temp module 801*c*, refine power module 801*d*, and command module 801*e*) can be implemented, for example, as a set of instructions or code that when accessed from memory 801 and executed by the processor 803, cause or otherwise facilitate light output control techniques described herein to be carried out. In other embodiments, the modules are implemented in hardware (e.g., gate-level logic or purpose-built silicon). Each of the modules will now be discussed in turn, with further reference to FIG. 8*b*, which illustrates a methodology for controlling the light output of the target lamp, using system 800.

As can be seen, the sensing module 801*a* is programmed or otherwise configured to sense lamp electrical data, by measuring actual input current and input voltage to the lamp. Recall that the input power applied to the lamp, which is the arc power, is the input lamp voltage multiplied by input lamp current. Thus, other lamp parameters of interest can be computed or otherwise derived from the sensed electrical data.

The power/losses module 801*b* is programmed or otherwise configured to determine lamp power inputs and losses, based on the sensed lamp electrical data. Recall that the net power available to heat up the lamp can be computed as the difference between the input power and the power losses, and the net energy ($E_{net}$) available to heat up the lamp is effectively the net power integrated over time. In one example embodiment, the power losses include thermal radiation from the surface from the arc tube ($P_{rad}$), *conduction along the electrodes* ($P_{con}$), and emitted radiation in the form of light ($P_{oth}$, $P_{vis}$), each of which can be estimated as previously discussed and may subsequently be refined, if so desired, and as also previously explained. The power/losses module 801*b* can store or otherwise has access to control parameters and/or lamp data used in computing lamp power losses, as previously described.

The temp module 801*c* is programmed or otherwise configured to estimate the lamp temperature that will result, based on the power/energy inputs and losses. Recall that the resulting change in lamp temperature $\Delta T=E_{net}/C_p(T_K)$, where the heat capacity $C_p(T_K)$ can be further separated into a function containing the temperature dependence and a scaling factor which corresponds roughly to the heat capacity at ambient temperature, as in $C_p(T_K)=C_{p20}*f(T_K)$. Further recall that the estimated lamp temperature can be multiplied (immediately prior to relight) by a TPAF, to further improve accuracy of light output control.

The refine power module 801*d* is programmed or otherwise configured to determine a refined lamp power input based on the estimated lamp temperature. The desired light output to be achieved can be provided, for example, manually by a user, or automatically based on an established process that defines target light outputs (e.g., via a curing process). Recall that the refined lamp power output can be computed, for instance, based on lamp temperature only (mode A), or on measured lamp parameters that make up an LO v P map (mode B), the maps reflecting lamp temperature, instantaneous input power, and LO. The refine power module 801*d* can store or otherwise has access to LO v P map data or $\eta(T)$ data used in estimating lamp efficacy, and may further include one or more inputs that allow for mode selection, as previously described.

The command module 801*e* is programmed or otherwise configured to issue or otherwise provide equipment commands to achieve the refined lamp power, which in turn provides the desired light output. Recall that the power circuit 805 is responsive to the commands issued by the command module 801*e* (or as a result of executing the command module 801*e*). The issued command can be, for example, a digital word (n-bits) that is received by the power circuit 805 and then converted to a corresponding analog current signal. Alternatively, the digital word or command can be used to select a resistance level in the power output current path, thereby effectively adjusting the output power provided by the power circuit 805. Other suitable command/power output schemes will be apparent in light of this disclosure.

Numerous other variations on the methodology will also be apparent in light of this disclosure. For instance, recall that if the light output vs. power description of the lamp becomes less accurate at lower temperatures, the lamp efficacy can be estimated during early run-up as a function of temperature only, in accordance with one embodiment of the present invention. In such embodiments, a threshold temperature $T_{threshold}$ can be established that defines when the efficacy switches from a function of temperature only, to a function of both temperature and instantaneous input power. Previously discussed Table 1 demonstrates one such example case. Various other lamp parameters (e.g., time on, light output and power input, etc) may be used to determine whether the first mode or second mode is used. In other embodiments, non-lamp parameters may be used to determine whether the first mode or second mode is used. Still in other embodiments, a combination of lamp and non-lamp parameters may be used to determine whether the first mode or second mode is used. Further note that a single period of continuous lamp operation may include any number of mode transitions.

Thus, the method of FIG. 8*b* can be executed by the system 800 for controlling the light output of a high intensity discharge lamp considering lamp efficacy as a function of both lamp temperature and instantaneous input power, or as a function of lamp temperature only. The light output can be described by a set of LO vs. P curves, with a different curve for each lamp temperature of interest. The lamp temperature can be tracked by estimating the energy inputs and outputs (losses) from the lamp. Example energy losses include radiation from the surface of the arc tube, conduction along the electrodes and capillaries, visible emission, and other emission. Variations in lamp temperature profile can be accounted for when specifying light output as a function of a single lamp temperature value, by using a TPAF. The method has applicability to general lamp operation including run-up, hot relight, and various arbitrary light output vs. time paths.

One embodiment of the present invention provides a system for controlling light output of a lamp. The system includes a power/losses module configured to determine lamp input power and lamp power losses, based on lamp electrical data including input current and input voltage to the lamp. The system further includes a temperature module configured to estimate lamp temperature, based on the lamp input power and lamp power losses. The system further includes a refine power module configured to determine a refined lamp input power based on the estimated lamp temperature. In one particular case, the system may include a sensing module configured to sense the lamp electrical data, by measuring actual input current and input voltage to the lamp. In another particular case, the refined lamp input power is computed based on lamp efficacy being a function of lamp temperature only, for at least a portion of the lamp operation. In another particular case, the refined lamp input power is computed based on lamp efficacy being a function of lamp temperature and instantaneous input power, for at least a portion of the lamp operation. In another particular case, the refine power module is further configured with a first mode and a second mode, and the refined lamp input power is computed based on lamp efficacy being a function of lamp temperature and instantaneous input power in the first mode, and the refined lamp input power is computed based on lamp efficacy being a function of lamp temperature only in the second mode. In one such case, one or more lamp parameters determine whether the first mode or second mode is used. The one or more lamp parameters may include, for example, lamp temperature, and one of the first or second modes is used when the lamp temperature is below an established temperature threshold. In another such case, non-lamp parameters determine whether the first mode or second mode is used. In another particular case, the system may include a command module configured to provide equipment commands to achieve the refined lamp input power. In another particular case, net power of the lamp is the difference between the lamp input power and the power losses, and net energy available to heat up the lamp is the net power integrated over time, and the lamp power losses include at least one of thermal radiation from surface of arc tube of the lamp, conduction along electrodes of the lamp, and emitted radiation in the form of light. In another particular case, the estimated lamp temperature reflects a single lamp temperature value included in a lamp temperature profile associated with the lamp, and variations in the lamp temperature profile can be accounted for by multiplying the estimated lamp temperature by a temperature profile adjustment factor. In another particular case, the refined lamp input power is computed based on one or more light output v power (LO v P) maps reflecting corresponding values of lamp temperature, instantaneous input power, and light output. In another particular case, one or more values of lamp temperature, instantaneous input power, and light output are obtained for a range of lamp operation scenarios (e.g., run-up operation, cool off following power interruption, and/or steady state operation at dimmed powers), and lamp control parameters of interest used in estimating the lamp power losses are determined based on lamp performance during the range of lamp operation scenarios. In another particular case, the refine power module is further configured to receive a desired light output that is manually provided by a user. In another particular case, the refine power module is further configured to receive a desired light output that is automatically provided based on an established process.

Another embodiment of the present invention provides a method for controlling light output of a lamp. The method includes determining lamp input power and lamp power losses, based on lamp electrical data including input current and input voltage to the lamp. The method further includes estimating lamp temperature, based on the lamp input power and lamp power losses. The method further includes determining a refined lamp input power based on the estimated lamp temperature. The method may further include sensing the lamp electrical data by measuring actual input current and input voltage to the lamp, and providing equipment commands to achieve the refined lamp input power. In one particular case, the refined lamp input power is computed based on lamp efficacy being a function of lamp temperature only, for at least a portion of the lamp operation. In another particular case, the refined lamp input power is computed based on lamp efficacy being a function of lamp temperature and instantaneous input power, for at least a portion of the lamp operation. In another particular case, the refined lamp input power is computed based on lamp efficacy being a function of lamp temperature and instantaneous input power in a first mode, and the refined lamp input power is computed based on lamp efficacy being a function of lamp temperature only in a second mode. In one such case, one or more lamp parameters determine whether the first mode or second mode is used. The one or more lamp parameters may include, for example, lamp temperature, and one of the first or second modes is used when the lamp temperature is below an established temperature threshold. In another such case, non-lamp parameters determine whether the first mode or second mode is used. In another particular case, the power losses include at least one of thermal radiation from surface of arc tube of the lamp, conduction along electrodes of the lamp, and emitted radiation in the form of light. In another particular case, the estimated lamp temperature reflects a single lamp temperature value included in a lamp temperature profile associated with the lamp, and variations in the lamp temperature profile can be accounted for by multiplying the estimated lamp temperature by a temperature profile adjustment factor. In another particular case, the refined lamp input power is computed based on one or more light output v power (LO v P) maps reflecting corresponding values of lamp temperature, instantaneous input power, and light output. In another particular case, one or more values of lamp temperature, instantaneous input power, and light output are obtained for a range of lamp operation scenarios (e.g., run-up operation, cool off following power interruption, etc), and lamp control parameters of interest used in estimating the lamp power losses are determined based on lamp performance during the range of lamp operation scenarios.

Another embodiment of the present invention provides a system for controlling light output of a lamp. In this example, the system includes a sensing module configured to sense lamp electrical data, by measuring actual input current and input voltage to the lamp. The system further includes a power/losses module configured to determine lamp input power and lamp power losses, based on the sensed lamp electrical data. The system further includes a temperature module configured to estimate lamp temperature, based on the lamp input power and lamp power losses. The system further includes a refine power module configured to determine a refined lamp input power based on the estimated lamp temperature, and a command module configured to provide equipment commands to achieve the refined lamp input power. The refine power module is further configured with a first mode and a second mode, and the refined lamp input power is computed based on lamp efficacy being a function of lamp temperature and instantaneous input power in the first mode, and the refined lamp input power is computed based on lamp efficacy being a function of lamp temperature only in the second mode.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A system for controlling light output of a lamp, the system comprising:

a power/losses module configured to determine lamp input power and lamp power losses, based on lamp electrical data including input current and input voltage to the lamp;

a temperature module configured to estimate lamp temperature, based on the lamp input power and lamp power losses; and a refine power module configured to determine a refined lamp input power based on the estimated lamp temperature wherein the refined lamp input power is computed based on lamp efficacy being a function of lamp temperature only, for at least a portion of the lamp operation.

2. The system of claim 1 further comprising:

a sensing module configured to sense the lamp electrical data, by measuring actual input current and input voltage to the lamp.

3. The system of claim 1 wherein the refined lamp input power is computed based on lamp efficacy being a function of lamp temperature and instantaneous input power, for at least a portion of the lamp operation.

4. The system of claim 1 wherein the refine power module is further configured with a first mode and a second mode, and the refined lamp input power is computed based on lamp efficacy being a function of lamp temperature and instantaneous input power in the first mode, and the refined lamp input power is computed based on lamp efficacy being a function of lamp temperature only in the second mode.

5. The system of claim 4 wherein one or more lamp parameters determine whether the first mode or second mode is used.

6. The system of claim 5 wherein the one or more lamp parameters include lamp temperature, and one of the first or second modes is used when the lamp temperature is below an established temperature threshold.

7. The system of claim 4 wherein non-lamp parameters determine whether the first mode or second mode is used.

8. The system of claim 1 further comprising:

a command module configured to provide equipment commands to achieve the refined lamp input power.

9. The system of claim 1 wherein net power of the lamp is the difference between the lamp input power and the power losses, and net energy available to heat up the lamp is the net power integrated over time, and the lamp power losses include at least one of thermal radiation from surface of arc tube of the lamp, conduction along electrodes of the lamp, and emitted radiation in the form of light.

10. The system of claim 1 wherein the estimated lamp temperature reflects a single lamp temperature value included in a lamp temperature profile associated with the lamp, and variations in the lamp temperature profile can be accounted for by multiplying the estimated lamp temperature by a temperature profile adjustment factor.

11. The system of claim 1 wherein the refined lamp input power is computed based on one or more light output v power (LO v P) maps reflecting corresponding values of lamp temperature, instantaneous input power, and light output.

12. The system of claim 1 wherein one or more values of lamp temperature, instantaneous input power, and light output are obtained for a range of lamp operation scenarios, and lamp control parameters of interest used in estimating the lamp power losses are determined based on lamp performance during the range of lamp operation scenarios.

13. The system of claim 1 wherein the refine power module is further configured to receive a desired light output that is manually provided by a user.

14. The system of claim 1 wherein the refine power module is further configured to receive a desired light output that is automatically provided based on an established process.

15. A method for controlling light output of a lamp, the method comprising:

determining lamp input power and lamp power losses, based on lamp electrical data including input current and input voltage to the lamp;

estimating lamp temperature, based on the lamp input power and lamp power losses; and determining a refined lamp input power based on the estimated lamp temperature wherein the refined lamp input power is computed based on lamp efficacy being a function of lamp temperature and instantaneous input power in a first mode, and the refined lamp input power is computed based on lamp efficacy being a function of lamp temperature only in a second mode.

16. The method of claim 15 further comprising:

sensing the lamp electrical data, by measuring actual input current and input voltage to the lamp; and providing equipment commands to achieve the refined lamp input power.

17. The method of claim 15 wherein the refined lamp input power is computed based on lamp efficacy being a function of lamp temperature only, for at least a portion of the lamp operation.

18. The method of claim 15 wherein the refined lamp input power is computed based on lamp efficacy being a function of lamp temperature and instantaneous input power, for at least a portion of the lamp operation.

19. The method of claim 15 wherein one or more lamp parameters determine whether the first mode or second mode is used.

20. The method of claim 19 wherein the one or more lamp parameters include lamp temperature, and one of the first or second modes is used when the lamp temperature is below an established temperature threshold.

21. The method of claim 15 wherein non-lamp parameters determine whether the first mode or second mode is used.

22. The method of claim 15 wherein the power losses include at least one of thermal radiation from surface of arc tube of the lamp, conduction along electrodes of the lamp, and emitted radiation in the form of light.

23. The method of claim 15 wherein the estimated lamp temperature reflects a single lamp temperature value included in a lamp temperature profile associated with the lamp, and variations in the lamp temperature profile can be accounted for by multiplying the estimated lamp temperature by a temperature profile adjustment factor.

24. The method of claim 15 wherein the refined lamp input power is computed based on one or more light output v power (LO v P) maps reflecting corresponding values of lamp temperature, instantaneous input power, and light output.

25. The method of claim 15 wherein one or more values of lamp temperature, instantaneous input power, and light output are obtained for a range of lamp operation scenarios, and lamp control parameters of interest used in estimating the lamp power losses are determined based on lamp performance during the range of lamp operation scenarios.

26. A system for controlling light output of a lamp, the system comprising:

a sensing module configured to sense lamp electrical data, by measuring actual input current and input voltage to the lamp;

a power/losses module configured to determine lamp input power and lamp power losses, based on the sensed lamp electrical data;

a temperature module configured to estimate lamp temperature, based on the lamp input power and lamp power losses;

a refine power module configured to determine a refined lamp input power based on the estimated lamp temperature, the refine power module further configured with a first mode and a second mode, and the refined lamp input power is computed based on lamp efficacy being a function of lamp temperature and instantaneous input power in the first mode, and the refined lamp input power is computed based on lamp efficacy being a function of lamp temperature only in the second mode; and a command module configured to provide equipment commands to achieve the refined lamp input power.

27. A system for controlling light output of a lamp, the system comprising:

a power/losses module configured to determine lamp input power and lamp power losses, based on lamp electrical data including input current and input voltage to the lamp;

a temperature module configured to estimate lamp temperature, based on the lamp input power and lamp power losses wherein the estimated lamp temperature reflects a single lamp temperature value included in a lamp temperature profile associated with the lamp, and variations in the lamp temperature profile can be accounted for by multiplying the estimated lamp temperature by a temperature profile adjustment factor; and a refine power module configured to determine a refined lamp input power based on the estimated lamp temperature.

* * * * *